US005129381A

United States Patent [19]

Nakajima

[11] Patent Number: 5,129,381

[45] Date of Patent: Jul. 14, 1992

[54] FUEL INJECTION SYSTEM FOR INTERNAL COMBUSTION ENGINE

[75] Inventor: Yuki Nakajima, Yokosuka, Japan

[73] Assignee: Nissan Motor Co., Ltd., Yokohama, Japan

[21] Appl. No.: 709,605

[22] Filed: Jun. 4, 1991

[30] Foreign Application Priority Data

Jun. 18, 1990 [JP] Japan ..... 2-158989
Aug. 21, 1990 [JP] Japan ..... 2-87203

[51] Int. Cl.[5] ..... F02M 51/00

[52] U.S. Cl. ..... 123/531; 123/533; 123/585; 239/533.2; 239/533.12

[58] Field of Search ..... 123/531, 533, 532, 534, 123/585; 239/533.1, 533.2, 533.12, 533.14, 552

[56] References Cited

U.S. PATENT DOCUMENTS 3,669,354 6/1972 Heiyer ..... 239/533.2
3,675,853 7/1972 Lapera ..... 239/533.2
4,616,621 10/1986 Kuroiwa et al. ..... 123/585
4,982,716 1/1991 Takeda et al. ..... 123/531
5,027,778 7/1991 Nogi et al. ..... 123/531
5,054,456 10/1991 Rush et al. ..... 123/531

FOREIGN PATENT DOCUMENTS 1-61461 4/1989 Japan .
1-66471 4/1989 Japan .

*Primary Examiner*—Andrew M. Dolinar
*Assistant Examiner*—M. Macy
*Attorney, Agent, or Firm*—Foley & Lardner

[57] ABSTRACT

A fuel injection system for an internal combustion engine has two intake valves for a combination chamber. The fuel injection system is comprised of a fuel injector installed in an intake manifold to supply fuel into the engine. The fuel injector is formed with at least two fuel discharge openings through which fuel sprays are ejected respectively toward the two intake valves. The fuel injector is further formed with at least one air discharge opening through which air is ejected at a high speed toward a position between the fuel sprays thereby to positively separate the fuel sprays from each other.

14 Claims, 6 Drawing Sheets

FUEL INJECTION SYSTEM FOR INTERNAL COMBUSTION ENGINE

BACKGROUND OF THE INVENTION

1. Field of the Invention

This invention relates to improvements in a fuel injection system for an internal combustion engine, and more particularly to a locational relationship between fuel discharge openings and air discharge openings formed in a fuel injector fo tthe purpose of improving fuel combustion in the engine.

2. Description of the Prior Art

In case air-fuel mixture is prepared by mixing air and fuel injected from a fuel injector disposed in an intake port of an engine, it is well known that fuel combustion in a combustion chamber of the engine largely depends on an atomization condition of the injected fuel. In view of this, many propositions of simultaneous injection of fuel and air (assist air) from a fuel injector have been made to improve atomization of fuel to be supplied to the combustion chamber under the effect of collision fo the assist air with the injected fuel.

By the way, it is known to provide two intake values for a combustion chamber to improve charging efficiency for purpose of raising engine speed and output power of the engine. In this case, it is necessary to uniformly distribute fuel so from the fuel injector toward the two intake valves. In this regard, it has been proposed that a fuel injector so injects fuel as to form fuel sprays separated and directed into two different directions, as disclosed in Japanese Utility Model Provisional Publication No. 1-61461. The fuel sprays are respectively ejected from two fuel discharge openings of the fuel injector, in which assist air is mixed with fuel in a mixing chamber prior to ejection of fuel from the fuel injector.

However, difficulties have been encountered in the above conventional technique in which fuel is mixed with assist air prior to ejection from the fuel injector, a major amount of fuel adheres on the wall surfaces of the fuel discharge opening and tends to form fuel flow thereon. Thus, in the conventional technique, although the fuel distribution in different directions are accomplished, fuel atomization cannot be effectively achieved.

From a point of view of improving fuel atomization, it may be effective to eject assist air around fuel spray immediately after the fuel spray is ejected from a fuel discharge opening fo the fuel injector, as disclosed in Japanese Utility Model Provisional Publication No. 1-66471. It will be understood that in this conventional technique, fuel vcannot adhere on the wall surface of the fuel ejection opening to form fuel flow. However, in this case, the assist air is rotatingly ejected around fuel spray, and therefore it is difficult to separate the fuel spray into different directions thereby making it impossible to distribute fuel spray toward two separate intake valves.

SUMMARY OF THE INVENTION

It is an object of the present invention to provide an improved fuel injection system which can solve the conflicting problems encountered in conventional fuel injection systems, improving fuel combustion in combustion chambers of an engine.

Another object of the present invention is to provide an improved fuel injection system which effectively achieves atomization of fuel to be supplied to an internal combustion engine without degrading distribution of fuel sprays in different directions.

A fuel injection system of the present invention is for an internal combustion engine having an intake air passageway. The fuel injection system is comprised of a fuel injector disposed to supply fuel into the intake air passageway. The fuel injector includes at least first and second fuel discharge openings through which fuel is discharged to form fuel sprays. Fuel from the first fuel discharge opening and fuel from the second fuel discharge opening are directed respectively to first and second directions which are different from each other. Fuel is introduced to the first and second fuel discharge openings. The fuel injector further includes at least one air discharge opening through which air (assist air) is discharged. Air from the air discharge opening is directed toward a position between the fuel sprays in the first and second directions so as to separate the fuel sprays. Air is introduced to the air discharge opening.

Accordingly, the ejected assist air thrusts at a high speed into between at least two fuel sprays distributed in different directions, thereby preventing mixing of the fuel sprays while improving fuel atomization. As a result, air-fuel mixture can be uniformaly distributed toward a plurality of intake valves in the engine thereby to improve fuel combustion in the engine.

BRIEF DESCRIPTION OF THE DRAWINGS

In the drawings, like reference numerals designate like parts and elements throughout all figures, in which.

DETAILED DESCRIPTION OF THE PREFERRED EMBODIMENTS OF THE INVENTION

Figure 1:
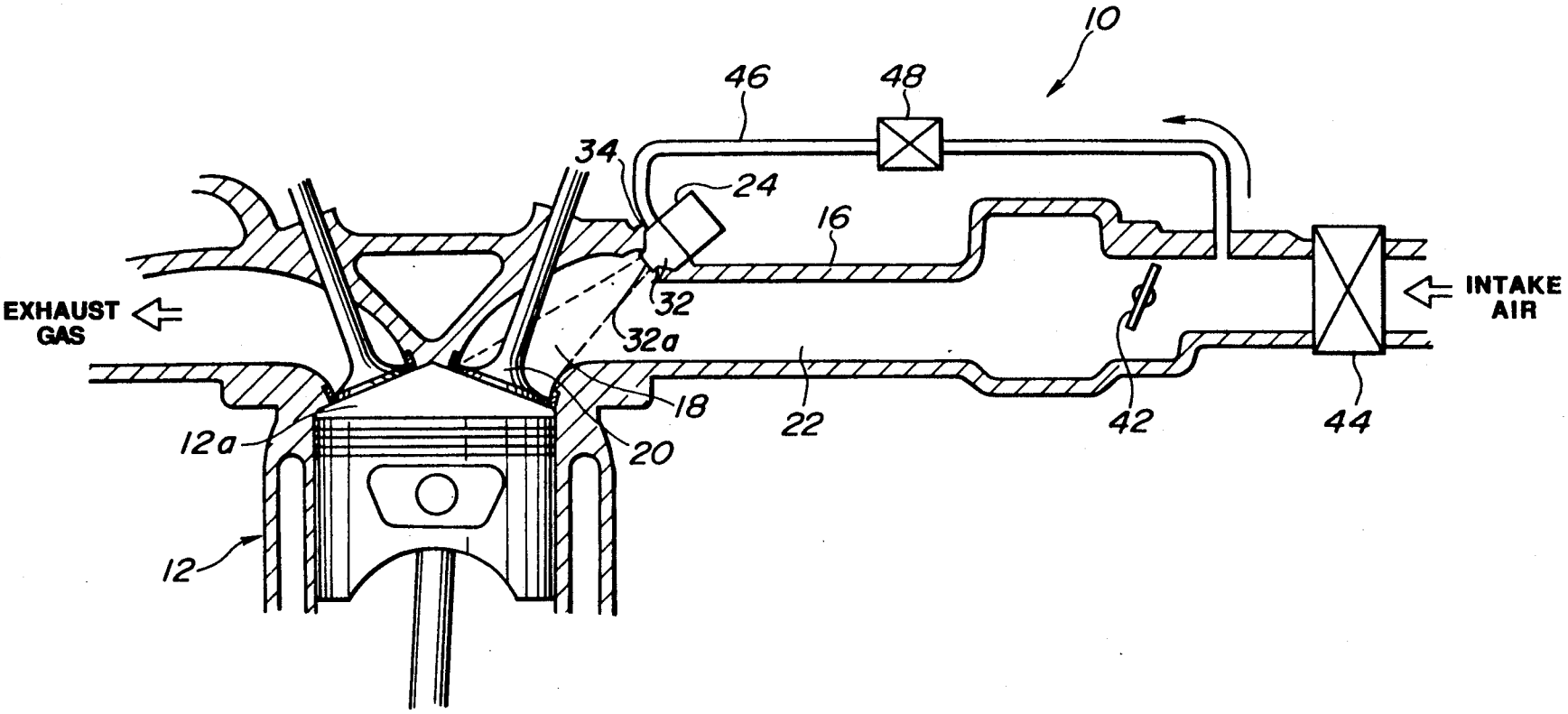
FIG. 1 is a schematic vertical sectional view of a first embodiment of a fuel injection system in accordance with the present invention; the present invention.
Figure 2:
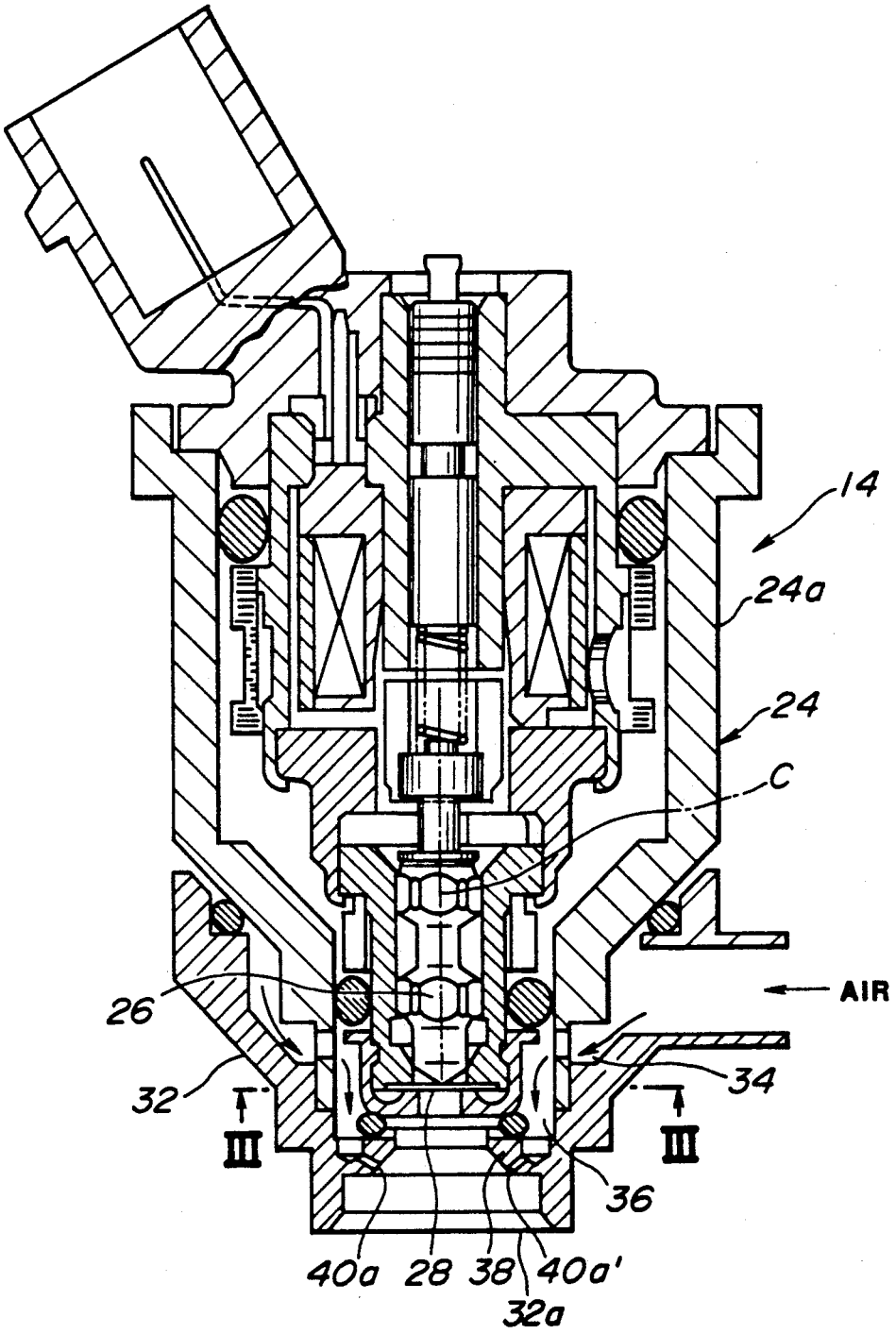
FIG. 2 is an enlarged vertical sectional view of a fuel injector of the fuel injection system of FIG. 1.
Figure 3:
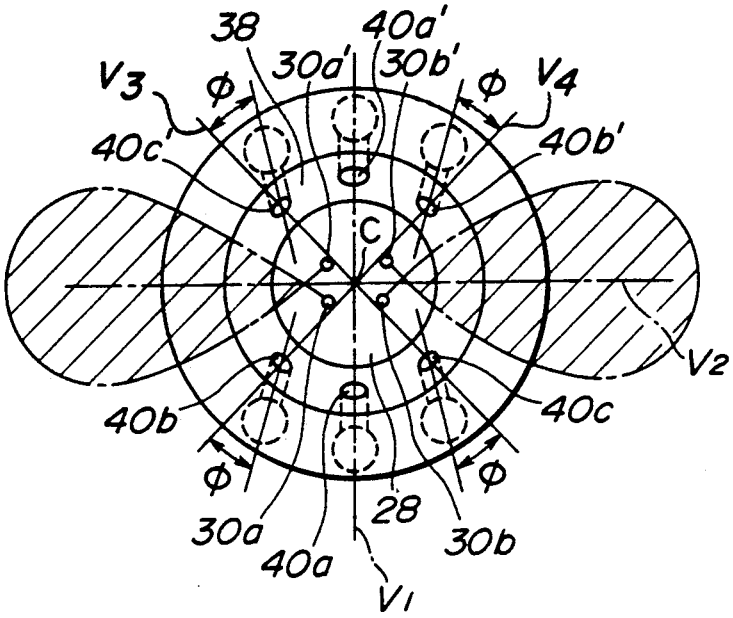
FIG. 3 is a sectional view taken in the direction of arrows substantially along the line III—III of FIG. 2.

Referring now to FIGS. 1, 2 and 3 and more specifically to FIG. 1 of the drawings, there is shown a first embodiment of a fuel injection system 10 according to the present invention for an internal comustion engine 12. In this embodiment, the engine 12 is of an automotive vehicle. The fuel injection system 10 comprises a fuel injector 14 which is fixedly mounted on an intake manifold 16 and disposed to inject fuel into an intake port 18 and toward intake valves 20 (only one valve shown). The intkae port 18 forms part of an intake air passageway 22 through which intake air flows into the combustion chamber(s) 12*a* of the engine 12. The intake air passageway 22 extends through the intake manifold 16.

As shown in FIG. 2, the fuel injector 14 includes an injector main body 24 which functions to inject fuel. The injector main body 24 includes a nozzle body 26 whose center axis C is aligned with the center axis of the injector main body 24 and of the fuel injector 14. A fuel discharge plate 28 is fixedly and sealing disposed at the tip end of the nozzle body 26 and sealingly disposed at the tip end of the nozzle body 26 and so located that the center axis of the nozzle body 26 is perpendicular to the fuel discharge plate 28. The fuel discharge plate 28 is formed with a plurality of fuel discharge openings 30*a*, 30*b*, 30*a*', 30*b*' through which fuel from the nozzle body 26 is discharged toward the intake port 18. It will be understood that the whole amount of fuel from the nozzle body 26 pass through the fuel discharge openings 30*a*, 30*b*, 30*a*', 30*b*'.

In this embodiment, there are a pair of the fuel discharge openings 30*a*, 30*a*' and a pair of the fuel discharge openings 30*b*, 30*b*'. The discharge openings 30*a*, 30*b* are positioned on the opposite sides of an imaginary vertical plane $V_1$ passing the center axis C of the nozzle body 26. Additionally, the fuel discharge openings 30*a*, 30*b* are located respectively at positions generally symmetrical with respect to the imaginary vertical plane $V_1$. The locational relationship between the fuel discharge openings 30*a*, 30*b*' with respect to the imaginary vertical plane $V_1$ is the same as that between the fuel charge openings 30*a*, 30*b*.

The fuel discharge openings 30*a*, 30*a*' are located on the opposite sides of an imaginary vertical plane $V_2$ passing through the center axis C of the nozzle body 26 and crossing perpendicularly the imaginary vertical plane $V_1$. Additionally, the fuel discharge openings 30*a*, 30*a*' are located respectively at positions generally symmetrical with respect to the imaginary vertical plane $V_2$. The locational relationship between the fuel discharge openings 30*b*, 30*b*' with respect to the imaginary vertical plane $V_2$ is the same as that between the fuel discharge openings 30*a*, 30*a*' .

Each of the fuel discharge openings 30*a*, 30*b*, 30*a*', 30*b*' is formed such that the axis thereof inclines relative to the center axis of the nozzle body 26 so that fuel discharged through the fuel discharge opening is directed outwardly of or far from the imaginary vertical plane $V_1$. Accordingly, fuel from the fuel discharge openings 30*a*, 30*b* are ejected generally in the opposite directions as indicated by a dot-dash line in FIG. 3 with respect to the imaginary vertical plane $V_1$, i.e., in two directions which lie on an imaginary plane (not identified) to which the center axis C of the nozzle body 26 is perpendicular and which differ in angle by about 180 degrees. Similarly, fuel from the fuel discharge openings 30*a*', 30*b*' are ejected generally in the opposite direction as indicated by a dot-dash line in FIG. 3 with respect to the iumaginary vertical plane $V_1$, on the imaginary vertical plane to which the center axis of the nozzle body 26 is perpendicular. Thus, the fuel through the fuel discharge openings 30*a*, 30*a*' is directed into the same discharge respect to the imaginary vertical plane $V_1$ thereby to form fuel spray as indicated by a hatched region in FIG. 3, and the fuel sprays through the fuel discharge openings 30*b*, 30*b*' is directed into the same direction with respect to the imaginary vertical plane $V_1$ thereby to form fuel spray indicated by a hatched region in FIG. 3.

In this embodiment, there are two intake valves 20 (only one intake valve shown in FIG. 1) which are separate from each other. In this connection, the fuel sprays ejected through the respective fuel discharge openings 30*a*, 30*a*' are directed to one of the intake valves 20, whereas the fuel sprays ejected through the fuel discharge openings 30*b*, 30*b*' are directed to the other of the intake valves 20.

As seen in FIG. 2, a generally frustoconical adapter 32 is sealingly displsed at the tip end section of the injector main body 24. More specifically, the adpater 32 is sealingly and coaxially fitted around the generally frustoconical tip end section of a casing 24*a* of the injector main body 24 in a manner to define an annular air passage 34 therebetween. The air passage 34 is in communication with an annular air gallery 36 formed inside the injector main body casing 24*a*. The adapter 32 is integrally formed at its inner peripheral wall with an annular projection wall 39 which radially inwardly extends. The inner peripheral portion of the wall 38 is separate from and sealingly connected with the fuel discharge plate 28. The annular projection wall 38 is formed with a pair of main air discharge openings 40*a*, 40*a*' and four auxiliary air discharge openings 40*b*, 40*b*', 40*c*, 40*c*'.

As clearly shown in FIG. 3, the main air discharge openings 40*a*, 40*a*' are located on the opposite sides of the imaginary vertical plane $V_2$ and located such that the imaginary vertical plane $V_1$ passes through the openings 40*a*, 40*a*'. Accordingly, the main air discharge openings 40*a*, 40*a*' are respectively at positions symmetrical with respect to the imaginary vertical plane $V_2$. In this embodiment, the axis of each main air discharge openings 40*a*, 40*a*' resides in the imaginary vertical plane $V_1$ and inclines relative to the center axis C of the nozzle body 26 as shown in FIG. 2 so that air ejected through each main air discharge opening 40*a*, 40*a*' is directed in the imaginary vertical plane $V_1$ on the imaginary plane (not identified) to which the center axis of the nozzle body 26 is perpendicular. In other words, air ejected through the main air discharge opening 40*a*, 40*a*' is directed obliquely toward an extension (not identified) of the center axis C of the nozzle body 26 so that two air streams from the respective openings 40*a*, 40*a*' cross each other at a central position through which the extension of the center axis of the nozzle body 26 passes. Accordingly, the air stream ejected through each main air discharge opening 40*a*, 40*a*' is directed between the fuel discharge openings 30*a*, 30*b*', and generally perpendicular to the direction in which fuel spray is ejected from the fuel discharge openings 30*a*, 30*b* on the imaginary plane to which the center axis C of the nozzle body 26 is perpendicular.

It will understood that the main air discharge openings 40*a*, 40*a*' are located between an imaginary vertical plane (not shown) passing through the fuel discharge openings 30*a*, 30*a*' and another imaginary vertical plane (not shown) passing through the fuel discharge openings 30*b*, 30*b*'. Additionally, the air discharge openings with respect to the direction of fuel ejection through the fuel discharge openings as clearly seen from FIG. 2. As a result, air streams from the respective air discharge openings 40*a*, 40*a*' serve to positively separate the fuel spray (ejected from the fuel discharge openings 30*a*, 30*a*') from the fuel spray (ejected from the fuel discharge openings 30*b*, 30*b*'), while promoting atomization of fuel upon collision with sprayed fuel.

The annular projection wall 38 is further formed with auxiliary air discharge openings 40*b*, 40*c*, 40*b*', 40*c*' through which air from the air gallery 36 is discharged. The auxiliary air discharge openings 40*b*, 40*c* are located on the opposite sides of the imaginary vertical plane $V_1$ and symmetrical with respect to the plane $V_1$. In other words, the auxiliary air discharge openings 40*a* is positioned between them along the periphery of the annular projection wall 38. Similarly the auxiliary air discharge openings 40*b*', 40*c*' are located on the opposite sides of the imaginary vertical plane $V_1$ and symmetrical with to the plave $V_1$. In other words, the auxiliary air discharge opening 40*b*', 40*c*'are located such that the main air discharge opening 40*a*' is positioned between them along the periphery of the annular projection wall 38.

As shown in FIG. 3, the axis of each of the auxiliary air discharge openings 40*c*, 40*d*, 40*c*', 40*d*' inclines by an angle $\phi$ relative to an imaginary vertical plane $V_3$, $V_4$ on the imaginary plane to which the center axis C of the nozzle body 26 is perpendicular, in such a manner as to approach the imaginary vertical plane $V_1$. According, the air stream ejected through each auxiliary air discharge opening 40*b*, 40*c*, 40*b*', 40*c*' serves to suppress the lateral spread of the fuel spray discharged from the fuel discahrge openings 30*a*, 30*a*' or 30*b*, 30*b*', while striking against the fuel spray discharged from the fuel discharge openings 30*a*, 30*a*' or 30*b*, 30*b*', while striking against the fuel spray thereby promoting fuel atomization. Thus, the air ejected through the main and auxiliary air discharge openings 40*a*, 40*a*', 40*b*, 40*b*', 40*c*', 40*c*' assists directing and atomization of the fuel spray and therefore referred to as "assist air".

The adapter 32 has a tip end second which is securely fitted in the intake manifold 16 and formed with an openings 32*a* through which fuel from the fuel discharge openings and air from the air discharge openings are supplied into the intake air passageway 22 and toward the intake valve 20.

Turning back to FIG. 1, the air passage 34 formed between the injector main body casing 24*a* and the adapter 32 is communicable with the intake passageway 22 upstream of a throttle valve 42 and downstream of an air flow meter 44 through an air supply passageway 46. Accordingly, the air passage 34 is supplied with air in accordance with a pressure differential between the upstream and downstream sides of the throttle valve 42, i.e., under an intake manifold vacuum prevailing in the intake passageway 22 downstream of the throttle valve 42. The air supplied through the air supply passageway 46 to the air passage 34 of the fuel injection 14 is ejected togther with fuel as indicatd by dotted lines in FIG. 1. The air (assist air) ejected from the fuel injection 14 joins together with air flowing through the intake passageway 22 at a location downstream of the fuel injection 24. Since these air flows are measured in flow amount by the air flow meter 44, the air-fuel ratio of an air-fuel mixture to be supplied to the engine 12 cannot be changed even under introduction of the assist air. The reference numeral 48 denotes a control valve disposed in the air supply passageway 46 to control the flow amount of the assist air in accordance with engine speed, intake manifold vacuum, enging coolant temperature and/or the like.

The manner of opeation of the fuel injection system 10 will be discussed hereinafter.

During operation of the engine 12, fuel is injected from the nozzle body 26 of the fuel injector 14 in timed relation to engine revolution, and air is sucked from the air gallery 36 in accordance with the intake manifold vacuum. The fuel is the passed through the fuel discharge openigns 30*a*, 30*a*' and 30*b*, 30*b*' of the fuel discharge plate 28 and sprayed distributedly leftward and rightward as shown in FIG. 3. At this time, the fuel spray from a pair of fuel discharge openings 30*a*, 30*a*' or 30*b*, 30*b*' spreads generally conically as indicated by the hatched region in FIG. 3 and directed toward one of the two intake valves 20.

Assist air is ejected at a high speed through the air discharge openings 40*a*, 40*a*', 40*b*, 40*b*', 40*c*, 40*c*'. The assist air through the main air discharge openings 40*a*, 40*a*' enters between the distributed fuel sprays thereby further separating them leftward and rightward, while promoting atomization of the sprayed fuel upon striking against the fuel at a high speed. The assist air through the auxiliary air discharge openings 40*b*, 40*b*', 40*c*, 40*c*' is directed toward the side of the conically spreaded fuel spray so as to suppress the spread of the fuel spray while promoting atomization of the sprayed fuel upon striking against the fuel at a high speed.

Thus, the fuel sprayed ejected through the fuel discharge plate 28 comes into collision and mixed with such high speed assist air, and therefore atomization of fuel is effectively accomplished. Additionally, assist air is introduced in a manner to securely cause the two fuel sprays to be separated oppositely with respect to center axis of the nozzle body 2l, so that equallized fuel sprays are ejected respectively toward the two intake valves 20. It was experimentally confirmed that fuel having a particle size of 300 $\mu$m was atomized to that having a particle size of about 20 to 30 $\mu$m under the action of assist air at an intake mainifold vacuum of $-500$ mmHg. As a result, a well-atomized uniform air-fuel mixture is supplied through the intake valves 20 into the combustion chamber 12*a* of the engine 12, so that stable and effective combustion can be achieved in the combustion chamber.

It will be appreciated that the diameter and the number of the main and auxiliary air discharge openings 40*a*, 40*a*', 40*b*, 40*b*', 40*c*,40*c*' may be suitably selected in accordance with the flow amount of the assit air and/or other requirements. In addition, the angle $\phi$ (shown in FIG. 3) of the axis of the auxiliary air discharge openings 40*b*, 40*b*', 40*c*, 40*c*' may be suitably set in accordance with the flow amount of the assist air.

Figure 4:
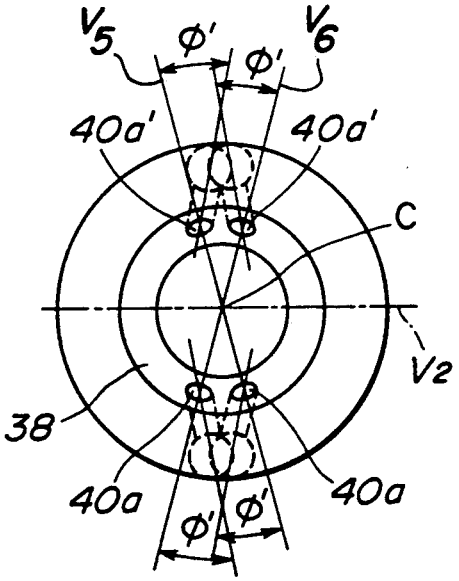
FIG. 4 is a sectional view similar to FIG. 3 but showing a second embodiment of the fuel injection system in accordance with the present invention.

FIG. 4 illustrates an essential part of a second embodiment of the fuel injection system 10 according to the present invention, which is similar to the embodiment of FIGS. 1 to 3 with the exception that there is no auxiliary air discharge opening. In this embodiment, the annular projection wall 38 is formed with a pair of main air discharge nozzles 40*a*, 40*a* and a pair of main air discharge nozzles 40*a*', 40*a*'. The air discharge openings 40*a*', 40*a*' with respect to the imaginary vertical plane $V_2$. In this case, the axis of each main air discharge opening inclines by an angle of $\phi'$ relative to an imaginary vertical plane $V_5$ or $V_6$ passing the center axis C of the nozzle body 26, on an imaginary plane to which the center axis of the nozzle body 26 is perpendicular. The imaginary vertical plane $V_5$, $V_6$ passes the centers of the opposite main air discharge openings 40*a*, 40*a*' which are positioned symmetrical with respect to the center axis of the nozzle body 26. The adjacent main air discharge openings 40*a*, 40*a* (40*a*', 40*a*') are positioned such that the axes thereof approach each other in a radially outward direction of the annular projection wall 38, on the imaginary plane to which the axis C is perpendicular. Although no auxiliary air discharge opening is formed in the annular projection wall 38, it will be understood that the effect according to the principle of the present invention can be obtained.

Figure 5:
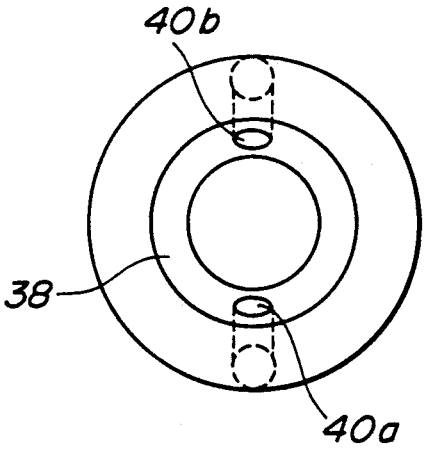
FIG. 5 is a sectional view similar to FIG. 4 but showing a third embodiment of the fuel injection system in accordance with the present invention.

FIG. 5 illustrates an essential part of a third embodiment of the fuel injection system in accordance with the present invention, similar to the embodiment of FIG. 4. In this embodiment, the annular projection wall 38 is formed with only two main air discharge openings 40*a*, 40*b* which are located in same positions as those in the first embodiment shown in FIG. 3 relative to the fuel discharge openings 30*a*, 30*b*, 30*a*', 30*b*' (not shown). Also in this embodiment, no auxiliary air discharge opening is formed in the annular projection wall 38.

Figure 6:
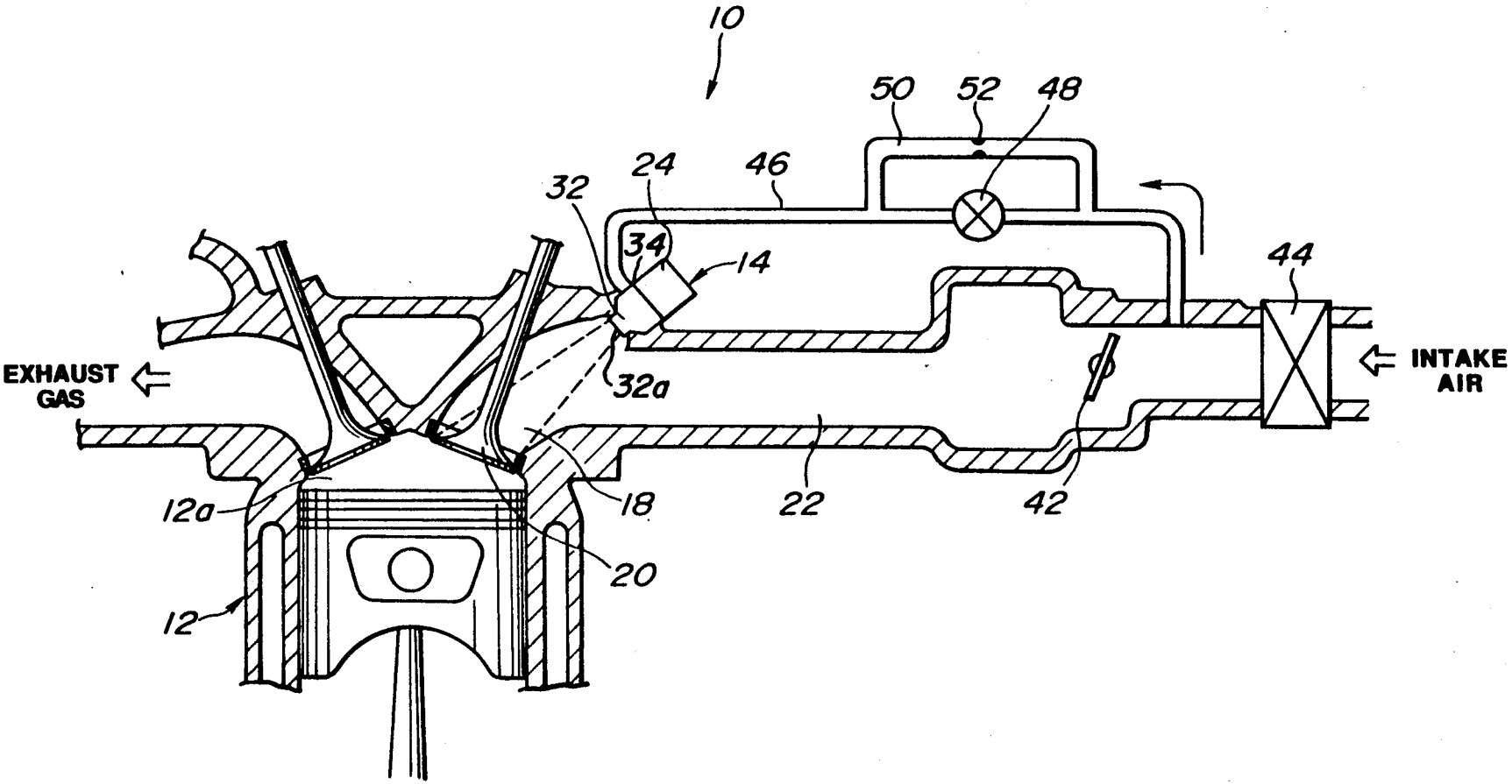
FIG. 6 is a schematic vertical sectional view similar to FIG. 1 but showing a fourth embodiment of the fuel injection system in accordance with the present invention.

FIG. 6 illustrates a fourth embodiment of the fuel injection system 10 in accordance with the present invention, similar to the embodiment of FIG. 1. In this embodiment, the control valve 48 is of the ON-OFF type and constructed and arranged to be closed to block the air supply passgeway 46 in an idling condition after completion of engine warm-up. Closure of the control valve 48 causes ejection of assist air from the fuel injector 24 to be stopped. It will be understood that the assist air provided too much air to maintain idling of the engine if it is supplied in the idling condition after completion of enging warm-up.

Figure 7:
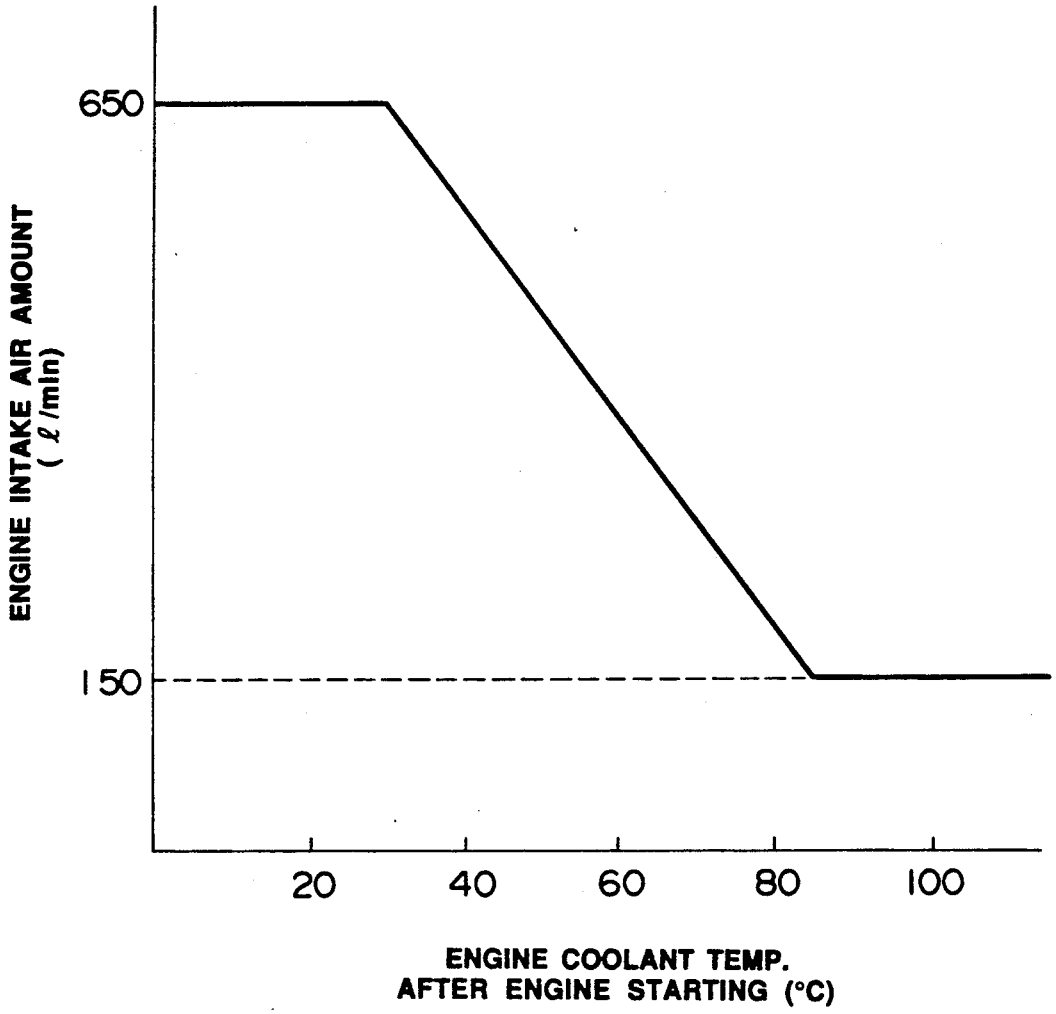
FIG. 7 is a graph showing the relationahip between engine intake air amount and engine coolant temperature after engine starting.

A bypass passage 50 is provided to establish communication 46 upstream and donwstream of the control valve 48. In other words, the bypass passage 50 has an end connected to the air supply passageway 46 upstream of the control 48 and the opposite end connected to the same passageway 46 downstream of the control vavle 48 with respect to flow of assist air through the air supply passageway 46. The bypass passage 50 is formed with a flow restrictor 52 having an orifice for restricting the flow With this arrangement, immediately after enging starting, the amount of intake air to be supplied into the engine 12 is considerably large. For example, the intake air amount is 650 l/min in an engine having a displacement of 3 l as shown in FIG. 7. Accordingly, even if the control valve 48 is fully opened in increase the flow amount of assist air to a high level such as 180 l/min to promoto atomization of fuel from the fuel injector 14, idling operation of the engine can be maintained without any problem.

During idling upon completion of engine warm-up, the amount of intake air becomes about ¼ of that of cold engine immediately after engine starting. For example, the intake air amount is about 150 l/min in the engine having 31 displacement as shown in FIG. 7. Accordingly, if the control valve 48 is fully opened to allow much assist air to flow through the air supply passageway 46, idling of the engine cannot be maintained because of a supply of too much air to the engine. In view of this, the control valve 48 is arranged to be switched OFF to be fully closed during idling upon completion of engine warm-up. However, according to this embodiment, a certain amount (for example, 100 l/min) of air flows through the bypass passage 50 and is supplied as assist air to the fuel injector 14. This assist air is ejected out of the fuel injector 14 through the air discharge openings 40*a*, 40*a*', 40*b*, 40*b*', 40*c*, 40*c*'. At this time, the amount of assist air is less and therefore idling can be maintained.

It will be understood that provision of the bypass passage 50 prevents a sudden large change in flow amount of air to be supplied to the engine, the change occuring owing to opening and closing of the control valve 48. This avoids deterioriation in drivability while protecting the air and fuel discharge openings of the fuel injector from being clogged with carbon from burnt gas blown back from the combustion chamber of the engine.

Figure 8:
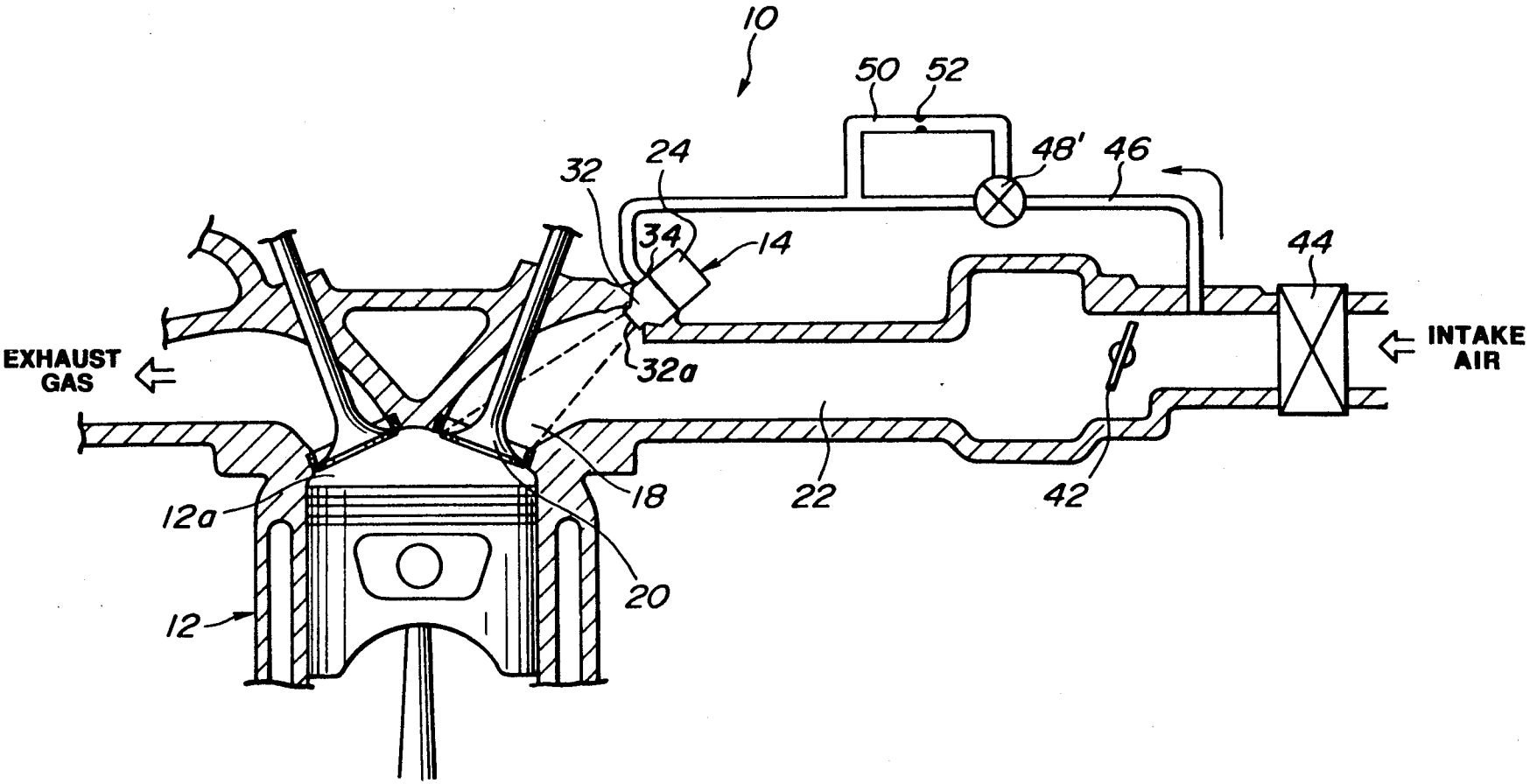
FIG. 8 is a schematic vertical sectional view similar to FIG. 6 but showing a fifth embodiment of the fuel injection system in accordance with the present invention.

FIG. 8 illustrates a fifth embodiment of the fuel injection system in accordance with the present invention, which is similar to the embodiment of FIG. 6 with the exception that a three-way control valve 48' is used in place of the control valve 48. In this embodiment, the three-way control valve 48' dipsposed at a location at which the bypass passage 50 is connected with the air supply passage 46. The three-way control valve 48' is arranged to be put into a position at which assist air flows through the bypass passage 50- during idling immediately after completion of engine warm-up.

What is claim is:

1. A fuel injection system for an internal combustion engine, comprising:

a fuel injector disposed to supply fuel into an intake air passageway of the engine, said fuel injection including means defining at least first and second fuel discharge openings through which fuel is discharged to form fuel sprays, fuel from said first fuel discharge opening and fuel from said second fuel discharge opening being directed respectively to first and second directions which are different from each other, and means defining at least one air discharge opening through which air is discharged, air from said air discharge opening being directed toward a position between the fuel sprays in the first and second directions so as to separate the fuel sprays;

means for introducting fuel to said first and second fuel discharge openings; and means for introducing air to said air discharge opening.

2. A fuel injection system for an internal combustion engine, comprising:

a fuel injection disposed to supply fuel into an intake air passageway of the eninge, said fuel injector including means defining at least first and second fuel discharge openings through which fuel is discharged into the intake air passageway, means for directing fuel from said first fuel discharge opening and fuel from said second fuel discharge opening respectively into first and second directions which are different from each other, and means defining at least a first air discharge opening through which air is discharged, said first air discharge opening being so located that air from said from air discharge opening is directed to a position between first and second vertical planes, said first vertical plane passing through said first fuel discharge opening and parallel to an axis of said fuel injection, said second vertical plane passing through said second fuel discharge opening and parallel with said first vertical plane;

means for introducing fuel under pressure to said first and second fuel discharge openings; and means for introducing air to said first air discharge opening.

3. A fuel injection system as claimed in claim 2, wherein said air discharge opening is located between said first and second vertical planes.

4. A fuel injection system as claimed in claim 2, wherein said air discharge opening is located downstream of said first and second fuel discharge openings with respect to movement of fuel from said fuel discharge openings.

5. A fuel injection system as claimed in claim 2, wherein said first and second fuel discharge openings are so formed that fuel from each fuel discharge opening is directed away from to the axis of said fuel injector.

6. A fuel injection system as claimed in claim 2, wherein said first air discharge opening is so formed that air from said air discharge opening is directed to approach the axis of said fuel injector.

7. A fuel injection system as claimed in claim 2, wherein said first and second fuel discharge openings are so formed that fuel from said first and second fuel discharge openings are directed into generally opposite directions with respect to a vertical plane passing through the axis of said fuel injector.

8. A fuel injection system as claimed in claim 2, wherein said first and second directions correspond respectively to directions of first and second intake valves of the engine, said first and second intake valves being separate from each other.

9. A fuel injection system as claimed in claim 2, wherein said fuel injector further includes mean defining third and fourth fuel discharge openings which are located respectively adjacent said first and second fuel discharge openings, the first and second vertical planes passing respectively through said third and fourth fuel discharge openings, fuel from said first and third fuel discharge openings forming a first fuel spray, fuel from said second and fourth fuel discharge openings forming a second fuel spray, said first and second fuel sprays being directed into different directions.

10. A fuel injection system as claimed in claim 2, wherein said fuel injector includes means defining a second air discharge opening through which air is discharge, said second air discharge opening being located opposite to said first air discharge opening and closing with a line connecting said first air discharge opening and the fuel injector axis, said second air discharge opening being located between the first and second vertical planes.

11. A fuel injection system as claimed in claim 10, wherein said fuel injector include means defining third and fourth air discharge openings through which air is discharged, said third and fourth air discharge openings being so located that said first air discharge opening is positioned therebetween. and means defining fifth and sixth air discharge openings through which air is discharged, said fifth and sixth air discharge openings being so located that said second air discharge opening is positioned therebetween, said third, fourth, fifth and sixth air discharge openings being located outside of a region between the first and second vertical planes.

12. A fuel injection system as claimed in claim 2, wherein said air introducing means includes means defining an air supply passageway through which air flows, said air supply passageway establishing communication between said air discharge opening and the intake air passageway upstream of the a throttle valve.

13. A fuel injection system as claimed in claim 12, wherein said air introducing means includes a control valve which controls flow of air through said air supply passageway in accordance with an engine operating condition.

14. A fuel injection system as claimed in claim 12, wherein said control valve is arranged to fully close said air supply passageway to block air flow therethrough during idling of the engine, wherein said air introducing means includes means defining a bypass passage which bypasses a portion of said air supply passageway, and a flow restrictor disposed in said bypass passage to restrict flow of air through said bypass passage, air flowing through said bypass passage when said portion of said air supply passageway is fully closed by said c control valve.

* * * * *